US005992521A

United States Patent [19]

Bergren et al.

[11] Patent Number: 5,992,521

[45] Date of Patent: Nov. 30, 1999

[54] METHOD AND SYSTEM FOR INCREASING OIL PRODUCTION FROM AN OIL WELL PRODUCING A MIXTURE OF OIL AND GAS

[75] Inventors: Frank E. Bergren; Jean S. Weingarten, both of Anchorage, Ak.

[73] Assignee: Atlantic Richfield Company, Los Angeles, Calif.

[21] Appl. No.: 08/982,993

[22] Filed: Dec. 2, 1997

[51] Int. Cl.[6] ..... E21B 43/38

[52] U.S. Cl. ..... 166/265; 166/105.5; 166/372

[58] Field of Search ..... 166/265, 372, 166/105.1, 105.4, 105.5, 105.6

[56] References Cited

U.S. PATENT DOCUMENTS

| | | | |
|---|---|---|---|
| 4,378,047 | 3/1983 | Elliott et al. | 166/68 |
| 4,444,251 | 4/1984 | Lefebvre et al. | 166/105 |
| 4,531,584 | 7/1985 | Ward | 166/265 |
| 4,531,593 | 7/1985 | Elliott et al. | 175/71 |
| 4,610,793 | 9/1986 | Miller | 210/767 |
| 4,981,175 | 1/1991 | Powers | 166/265 |
| 4,995,456 | 2/1991 | Cornette et al. | 166/51 |
| 5,343,945 | 9/1994 | Weingarten et al. | 166/105.5 |
| 5,385,446 | 1/1995 | Hays | 415/202 |
| 5,431,228 | 7/1995 | Weingarten et al. | 166/357 |
| 5,450,901 | 9/1995 | Ellwood | 166/266 |
| 5,482,117 | 1/1996 | Kolpak et al. | 166/265 |
| 5,605,193 | 2/1997 | Bearden et al. | 166/370 |
| 5,730,871 | 3/1998 | Kennedy et al. | 210/512.2 |
| 5,794,697 | 8/1998 | Wolflick et al. | 166/265 |

FOREIGN PATENT DOCUMENTS

| | | | |
|---|---|---|---|
| 94/18432 | 8/1994 | European Pat. Off. | 166/265 |

OTHER PUBLICATIONS

"New Design for Compact Liquid–Gas Partial Separation: Downhole and Surface Installations for Artificial Lift Applications" by J.S. Weingarten, M.M. Kolpak, S.A. Mattison and M.J. Williamson, SPE 30637, Society of Petroleum Engineers, 1995.

"Jet Pumping" by Hal Petrie, Chapter 6 of The Technology of Artifical Lift Methods—vol. 2b.

"Development and Testing of a Compact Liquid–Gas Auger Partial Separator for Downhole or Surface Applications" by J.S. Weingarten, M.M. Kolpak, S.A. Mattison and M.J. Williamson, Society of Petroleum Engineers, 1997.

"Slim Phase 4™", Sperry–Sun Drilling Services, 1994, 1995.

"New Design Expands Success of Slim Phase 4™ MWD Resistivity Tool", Real–time—Slim Phase 4™, Sperry Sun Drilling Services, Fall 1995.

"Improved Production Log Interpretation in Horizontal Wells Using Pulsed Neutron Logs", by J.L. Brady, J.J. Kohring and R.J. North, SPE 36625, Society of Petroleum Engineers, 1996.

Glossary of Terms & Expressions Used in Well Logging, Second Edition, Society of Professional Well Log Analysis, Oct., 1984.

*Primary Examiner*—William Neuder
*Attorney, Agent, or Firm*—F. Lindsey Scott

[57] ABSTRACT

A method for enriching a mixture of a first fluid and a second fluid in the second fluid by separating at least a portion of the first fluid from the mixture of the first fluid and the second fluid; directing the separated first fluid into a jet pump; injecting a power fluid into the jet pump to form a mixture of the power fluid and the separated first fluid; discharging the mixture of power fluid and separated first fluid; and recovering the enriched mixture.

20 Claims, 5 Drawing Sheets

METHOD AND SYSTEM FOR INCREASING OIL PRODUCTION FROM AN OIL WELL PRODUCING A MIXTURE OF OIL AND GAS

FIELD OF THE INVENTION

This invention relates to a method for increasing oil production from oil wells producing a mixture of oil and gas through a well bore penetrating an oil bearing formation containing a gas cap zone and an oil bearing zone by separating and reinjecting a portion of the gas into the gas cap zone prior to producing the mixture of oil and gas from the well bore.

BACKGROUND OF THE INVENTION

In many oil fields the oil bearing formation comprises a gas cap zone and an oil bearing zone. Many of these fields produce a mixture of oil and gas with the gas-to-oil ratio (GOR) increasing as the field ages. This is a result of many factors well known to those skilled in the art.

The produced mixture of oil and gas is typically separated into an oil portion and a gas portion at the surface. The gas portion may be marketed as a natural gas product, reinjected into the gas cap to maintain pressure therein, or the like. Further, many such fields are located in parts of the world where it is difficult to economically transport the gas to market; therefore, the reinjection of the gas into the gas cap preserves the availability of the gas as a resource in the future as well as maintaining pressure in the gas cap.

Such wells may produce gas/oil mixtures having a GOR of over 25,000 and comprise less than 1% liquids. Typically, however, a GOR from 2,500 to 4,000 is more than sufficient to carry the oil to the surface as a gas/oil mixture.

Normally the oil is dispersed as finely divided droplets or as a mist in the gas so produced. Typically, in fields having such wells, gathering lines gather the gas/oil mixture into common lines and pass the mixture to production facilities or the like where crude oil and condensate is separated from the gas and transported as crude oil. Natural gas liquids are then recovered from the gas and optionally combined with the crude oil and condensate. Optionally, a miscible solvent which comprises carbon dioxide, nitrogen, and a mixture of hydrocarbons containing from one to about five carbon atoms may be recovered from the gas stream and used for enhanced oil recovery or the like. The remaining gas stream is then passed to a compressor where it is compressed for reinjection. The compressed gas is reinjected through injection wells, an annular section of a production well, or the like back into the gas cap.

It can be appreciated that surface facilities required for separating and returning sufficient gas to the gas cap to maintain oil production must be of substantial capacity. Clearly the substantial size of the surface equipment required to process the mixture of oil and gas, and the capacity limitations on the ability to handle the produced gas, may become a limiting factor on the quantity of oil which can be produced from the formation.

To reduce the size of the surface equipment required to process the mixture of oil and gas, U.S. Pat. No. 5,431,228 entitled "Down Hole Gas-Liquid Separator for Wells" issued Jul. 11, 1995 to Weingarten et al and assigned to Atlantic Richfield Company, discloses that an auger separator can be used downhole to separate a gas and liquid stream for separate recovery at the surface. A gaseous portion of the stream is recovered through an annular space in the well, and liquids are recovered through a production tubing.

In SPE 30637 entitled "New Design for Compact Liquid-Gas Partial Separation: Down Hole and Surface Installations for Artificial Lift Applications" by Weingarten et al, it is disclosed that auger separators as disclosed in U.S. Pat. No. 5,431,228 can be used for downhole and surface installations for gas/liquid separation. While such separations are particularly useful as discussed for artificial or gas lift applications and the like, all of the gas and liquid is still recovered at the surface for processing as disclosed. Accordingly, the surface equipment for processing gas may still impose a significant limitation on the quantities of oil which can be produced from a subterranean formation which produces oil as a mixture of gas and liquids.

To reduce the quantity of gas recovered at the surface, and hence to reduce the GOR of production fluids, co-pending patent application, Ser. No. 757,857 entitled "A Method for Increasing Oil Production from An Oil Well Producing A Mixture of Oil and Gas" filed Nov. 27, 1996, by John R. Wolflick, James L. Cawvey, Jerry L. Brady, John R. Whitworth, and David D. Hearn, and assigned to Atlantic Richfield Company, discloses using a rotating compressor mounted downhole in combination with an auger separator to separate and compress the gas downhole and inject it into the gas cap without using surface equipment.

A continuing search has been directed to the development of methods which can reliably reduce the GOR of oil and gas mixtures produced from subterranean formations, and thereby reduce the required capacity of surface equipment to process the produced oil and gas mixtures.

SUMMARY OF THE INVENTION

According to the present invention it has been found that a mixture of a first fluid and a second fluid may be enriched in the second fluid to produce an enriched mixture by separating at least a portion of the first fluid from the mixture of first and second fluids; directing the separated first fluid into a jet pump; injecting a power fluid into the jet pump at a pressure greater than the pressure of the first fluid to form a mixture of the power fluid and the separated first fluid; discharging the mixture of power fluid and separated first fluid at a pressure greater than the pressure of the first fluid; and recovering the enriched mixture.

In further accord with the present invention, it has been found that increased quantities of oil can be produced from an oil well producing a mixture of oil and gas through a well bore penetrating an oil bearing formation containing a gas cap zone and an oil bearing zone by separating at least a portion of the gas from the mixture of oil and gas in the oil well to produce a separated gas and an oil-enriched mixture; directing the separated gas into a jet pump; injecting a power fluid at a pressure greater than the pressure of the separated gas into the jet pump to form a mixture of the power fluid and the separated gas, the mixture being at a pressure greater than the pressure of the gas in the gas cap zone; injecting the mixture of power fluid and separated gas into the gas cap zone; and recovering at least a substantial portion of the oil-enriched mixture.

The present invention further comprises a system for increasing oil production from an oil well producing a mixture of oil and gas through a well bore penetrating an oil bearing formation containing a gas cap zone and an oil bearing zone wherein the system comprises: an auger separator positioned in a first tubular member positioned in the oil well, the first tubular member being in fluid communication with the oil-bearing zone and oil and gas processing equipment at a surface; a jet pump positioned in fluid communication with the auger separator to receive a separated gas from the auger separator at a jet pump inlet chamber; a second tubular member positioned in fluid communication with a source of fluid at a suitable pressure at the surface and a nozzle inlet of the jet pump; and a discharge passageway in fluid communication with a discharge from the jet pump and with the gas cap zone.

The present invention further comprises a system for separating a mixture of oil and gas in a pipeline, the system comprising an auger separator positioned in the pipeline with its inlet positioned to receive a mixture of oil and gas from the pipeline; a jet pump positioned in the pipeline with an inlet in fluid communication with a gas outlet from the auger separator; a nozzle inlet in fluid communication with a source of gas at a pressure higher than the gas in the pipeline; and an outlet in fluid communication with a discharge port through the pipeline.

The present invention may also be used to separate mixtures of liquids such as oil and water, as well as mixtures of liquids and gases.

DESCRIPTION OF THE PREFERRED EMBODIMENTS

In the discussion of the Figures, the same numbers will be used to refer to the same or similar components throughout. Not all components of the wells necessary for the operation of the wells have been discussed in the interest of conciseness.

Figure 1:
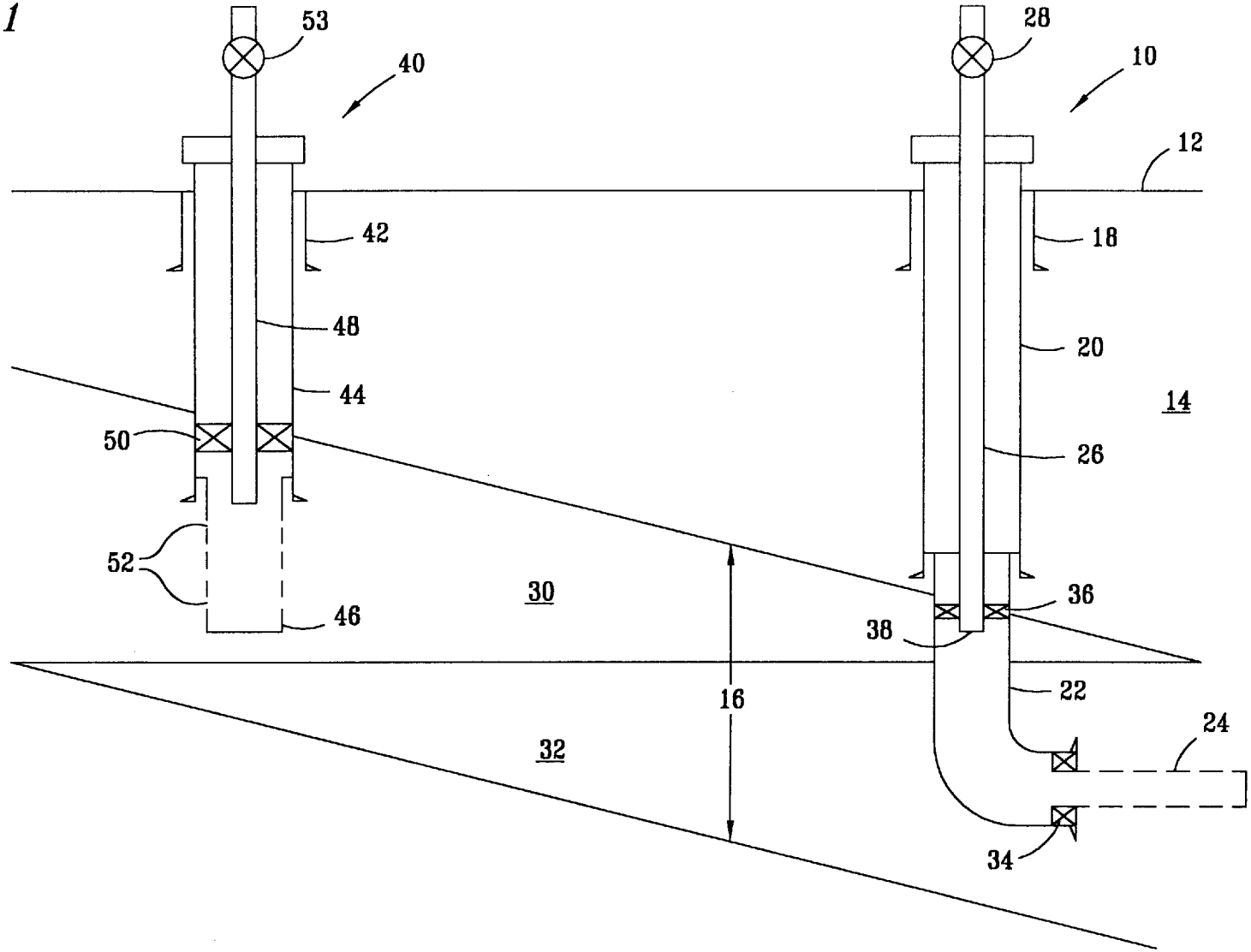
FIG. 1 is a schematic diagram of a production well, according to the prior art, for producing a mixture of oil and gas from a subterranean formation and an injection well for injecting gas back into a gas cap in the oil bearing formation.

In FIG. 1, a production well 10 is positioned to extend from a surface 12 through an overburden 14 to an oil bearing formation 16. The production well 10 includes a first casing section 18, a second casing section 20, a third casing section 22, and a fourth casing section 24, it being understood that the well 10 may alternatively include more or fewer than four casing sections. The use of such casing sections is well known to those skilled in the art for the completion of oil wells. The casings are of a decreasing size and the fourth casing 24 may be a slotted liner, a perforated pipe, or the like. While the production well 10 is shown as a well which has been curved to extend horizontally into the formation 16, it is not necessary that the well 10 include such a horizontal section and, alternatively, the well 10 may extend vertically into the formation 16. Such variations are well known to those skilled in the art for the production of oil from subterranean formations.

The well 10 also includes a production tubing 26 for the production of fluids from the well 10. The production tubing 26 extends upwardly to a wellhead 28 shown schematically as a valve. The wellhead 28 contains the necessary valving and the like to control the flow of fluids into and from the well 10, the production tubing 26, and the like.

The formation 16 includes a gas cap zone 30 and an oil bearing zone 32 below the gas cap zone. Pressure in the formation 16 is maintained by gas in the gas cap zone 30 and, accordingly, it is desirable in such fields to maintain the pressure in the gas cap zone as hydrocarbon fluids are produced from the formation 16 by reinjecting gas. The formation pressure may be maintained by water injection, gas injection, or both. The reinjection of gas requires the removal of the liquids from the gas prior to recompressing the gas, and injecting the gas back into the gas cap zone 30. Typically, the GOR of oil and gas mixtures recovered from such formations increases as the level of the oil bearing zone drops, as a result of the removal of oil from the oil bearing formation 16.

In the well 10, a packer 34 is used to prevent the flow of fluids in the annular space between the third casing section 22 and the fourth casing section 24. A packer 36 is positioned to prevent the flow of fluids in the annular space between the exterior of the production tubing 26 and the interior of the casing 20 and that portion of the interior of the casing 22 above the packer 36. Fluids from the formation 16 can thus flow upwardly through the production tubing 26 and the wellhead 28 to processing equipment at the surface, as described previously. The well 10, as shown, produces fluids under the formation pressure and does not require a pump.

Also shown in FIG. 1 is an injection well 40 comprising a first casing section 42, a second casing section 44, a third casing section 46, and an injection tubing 48. The flow of fluid upwardly between the outside of the tubing 48 and the inside of the casing 44 is prevented by a packer 50. Gas is injected into the gas cap zone 30 through perforations 52 in the third casing section 46. The flow of gases into the well 40 is regulated by a wellhead 53 shown schematically as a valve.

In operation, gas produced from the well 10 is reinjected into the gas cap zone 30 through the injection well 40. The reinjected gas thereby maintains pressure in the formation 16 and remains available for production and use as a fuel resource at a later date if desired.

In wells which produce excessive amounts of gas, the necessity for handling the large volume of gas at the surface can limit the ability of the formation to produce oil. The installation of sufficient gas handling equipment to separate the large volume of gas from the oil for use as a product, or for reinjection into the gas cap zone 30 can be prohibitively expensive.

Figure 2:
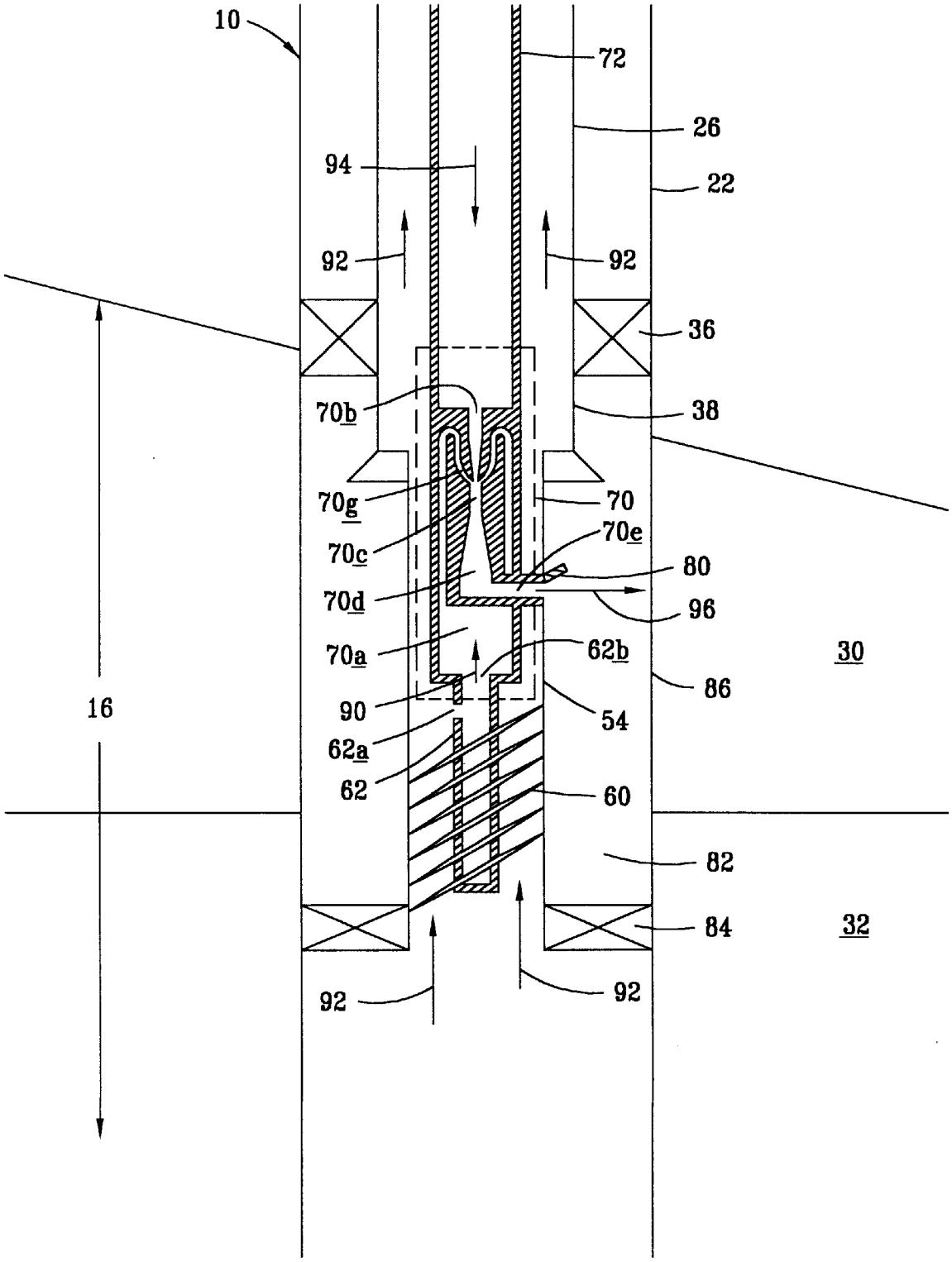
FIG. 2 is schematic diagram of an embodiment of the system of the present invention positioned in an existing well bore.

In FIG. 2, an embodiment of the present invention is shown which permits the downhole separation and reinjection of at least a portion of the produced gas, and which permits the production of an oil-enriched mixture of oil and gas. The embodiment shown in FIG. 2 comprises a modification of the production well 10 in which a tubular section 54 is positioned in a manner well known to those skilled in the art in a lower end 38 of the production tubing 26. The positioning of such tubular members by wire line or coiled tubing techniques is well known to those skilled in the art and will not be discussed. As previously noted, the packer 36 is positioned to prevent the flow of fluids in the annular space between the exterior of the production tubing 26 and the interior of the casing 22.

An auger or other downhole separator 60 is positioned in the tubular section 54. Auger separators of the type shown are more fully disclosed and discussed in U.S. Pat. No. 5,431,228, "Down Hole Gas Liquid Separator for Wells", issued Jul. 11, 1995 to Jean S. Weingarten et al, and in "New Design for Compact-Liquid Gas Partial Separation: Down Hole and Surface Installations for Artificial Lift Applications", Jean S. Weingarten et al, SPE 30637 presented Oct. 22–25, 1995, both of which references are hereby incorporated in their entirety by reference. Auger separators such as the separator 60 are considered to be well known to those skilled in the art and are effective to separate at least a major portion of the gas from a flowing stream of liquid (e.g., oil) and gas by causing the fluid mixture to flow around a circular path thereby forcing the liquids to the outside by centrifugal force with the gases being separated through a central discharge tube 62 from the auger separator 60. The central discharge tube 62 includes one or more inlets 62*a* (only one of which is shown) for receiving the separated gases, and an outlet 62*b* for discharging the separated gases.

A jet pump 70 (enclosed within a dashed outline as shown in FIG. 2) is positioned in the tubular section 54 above the auger separator 60 for receiving, through an inlet chamber 70*a* of the jet pump 70, recovered gas discharged from the outlet 62*b*. The jet pump 70 further includes a nozzle inlet 70*b* connected to a tubular member shown as a coiled tubing 72 which extends through the production tubing 26 and the wellhead 28 (FIG. 1) to a source of gas at a pressure greater than the pressure in the gas cap to provide gas at a suitable pressure to the nozzle inlet 70*b* of the jet pump 70.

Figure 3:
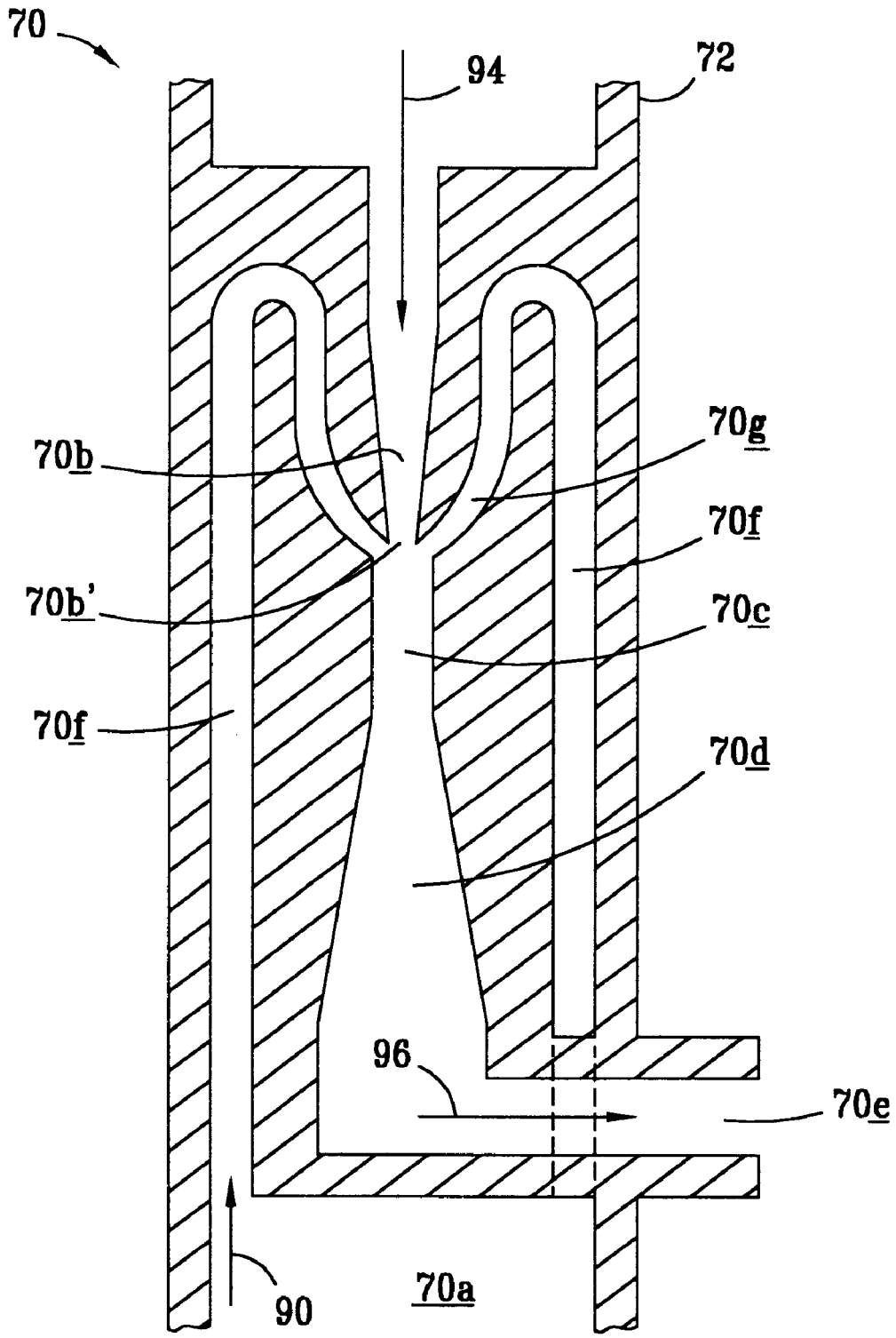
FIG. 3 is an enlargement of a portion of the schematic diagram of FIG. 2 depicting a jet pump positioned in an existing well bore for use in the system of the present invention.

As more clearly shown in FIG. 3, the jet pump 70 includes, in addition to the inlet chamber 70*a* and nozzle inlet 70*b*, a throat portion 70*c*, a diffuser portion 70*d*, and a discharge outlet 70*e*. The diameter of a discharge end 70*b*' of the nozzle inlet 70*b* is smaller than the diameter of the throat portion 70*c* and is configured for discharging fluid, received from the coiled tubing 72, as a jet stream into the throat portion 70*c*. An annular passageway 70*f* in the jet pump 70 provides fluid communication from the inlet chamber 70*a* to a production inlet chamber 70*g* which circumscribes the nozzle inlet 70*b* so that separated gas in the inlet chamber 70*a* may pass through the passageway 70*f* and the production inlet chamber 70*g* into the throat portion 70*c*, and be entrained by the jet stream of fluid discharged by the nozzle inlet 70*b*.

Jet pumps of the type shown, as well as the corresponding design and pressure equations, are considered to be well known to those skilled in the art, and are more fully disclosed and discussed by Hal Petrie in *The Technology of Artificial Lift Methods-Volume* 2*b*, "Jet Pumping", hereby incorporated in its entirety by reference. Jet pumps, such as the jet pump 70, are effective to convert the pressure of the power fluid to a velocity head, as the power fluid is received through the coiled tubing 72 and passes through a venturi formed by the nozzle inlet 70*b* and the throat portion 70*c*. The separated gases are entrained in and substantially mixed with the power fluid, and momentum and energy is transferred from the power fluid to the separated gases. The total momentum and energy of the mixture of power fluid and separated gases is then converted in the diffuser portion 70*d* to a static pressure head which is greater than the pressure in the gas cap zone 30. It can be appreciated that, unlike rotating equipment such as a compressor, the jet pump 70 has no moving parts.

As shown in FIG. 2, a check valve 80 or a suitable opening is provided in the tubular section 54 between the discharge outlet 70*e* of the jet pump 70 and a confined annular space 82 defined by the packer 36 and a packer 84 positioned between the outside of the tubular section 54 and the inside of the casing 22. Perforations 86 are suitably formed in the casing 22 for providing fluid communication between the annular space 82 and the gas cap zone 30.

In the operation of the device shown in FIG. 2, a mixture of oil and gas flows upwardly from the formation 16 into the tubular section 54 and into the auger separator 60. Typically, at least 50 to 60% of the gas flowing through the auger separator 60 is separated from the liquids contained in the mixture. As shown schematically by an arrow 90 in FIG. 3, the separated gases flow through the jet pump 70 as described below. However, as shown schematically by arrows 92, the liquids and non-separated gases flow around the jet pump 70 and through the annular space between the production tubing 26 and the coiled tubing 72 to the surface where they are recovered through the wellhead 28 (FIG. 1) and passed to gas/liquid separation and processing equipment and the like at the surface. Gas separated at the surface may then be compressed to a pressure exceeding the pressure of the gas in the gas cap zone 30, to thereby create power fluid, which is then injected through the coiled tubing 72 to the nozzle inlet 70*b*. Alternatively, the gas separated at the surface may be reinjected through an injection well, produced as a gas product, or the like.

The separated gas, shown by the arrow 90, is collected in the central discharge tube 62 and passed into the jet pump 70 via the inlet chamber 70*a*, the annular passageway 70*f*, and the production inlet chamber 70*g* into the throat portion 70*c*. Power fluid, discussed above, is pumped down the coiled tubing 72 to the nozzle inlet 70*b*, as shown by arrow 94, and is discharged as a jet stream into the throat portion 70*c*. The separated gas is then entrained by and mixed with the jet stream of power fluid in the throat 70*c* whereby momentum and energy is transferred from the power fluid to the separated gases. The total momentum and energy of the mixture of power fluid and separated gases is then converted in the diffuser portion 70*d* to a static pressure head which exceeds the pressure of the gas in the gas cap zone 30. The mixture of power fluid and separated gases is then passed, as shown by an arrow 96, through the check valve 80 into the annular space 82 and through the perforations 86 in the casing 22 into gas cap zone 30.

By the use of the device shown in FIG. 2, a portion of the gas is removed from the gas/liquid mixture produced from the formation 16 and is reinjected downhole without the necessity for passing the separated portion of the gas to the surface for treatment. This removal of a significant portion of the gas downhole relieves the load on the surface gas processing equipment since a smaller volume of gas is produced to the surface. In many fields, GOR values as high as 25,000 are encountered; however, GOR values from 2,500 to 4,000 are generally more than sufficient to carry the produced liquids to the surface. A significant amount of the gas can thus be removed and reinjected downhole, while enriching in oil the mixture of oil and gas produced to the surface. This significantly increases the amount of oil which can be recovered from formations which produce gas and oil in mixture, which amount of recovered oil is limited by the amount of gas handling capacity available at the surface.

Figure 4:
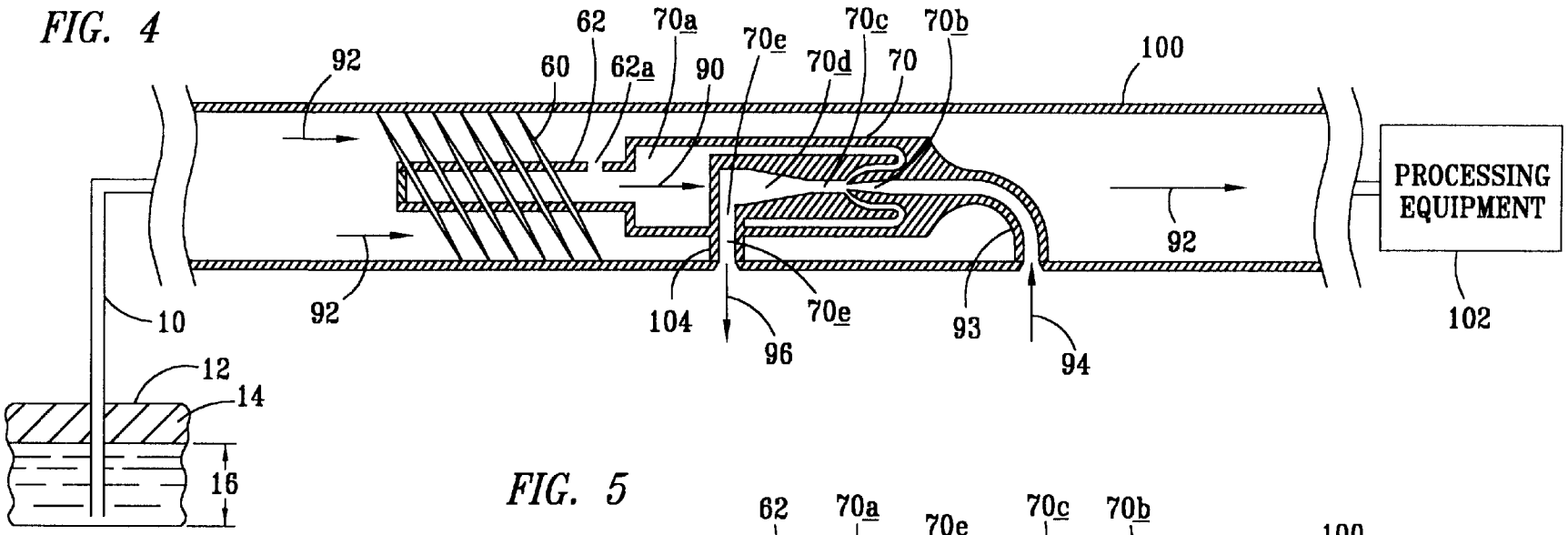
FIGS. 4 and 5 are schematic diagrams of alternate embodiments of the system of the present invention positioned in a flow line.
Figure 5:
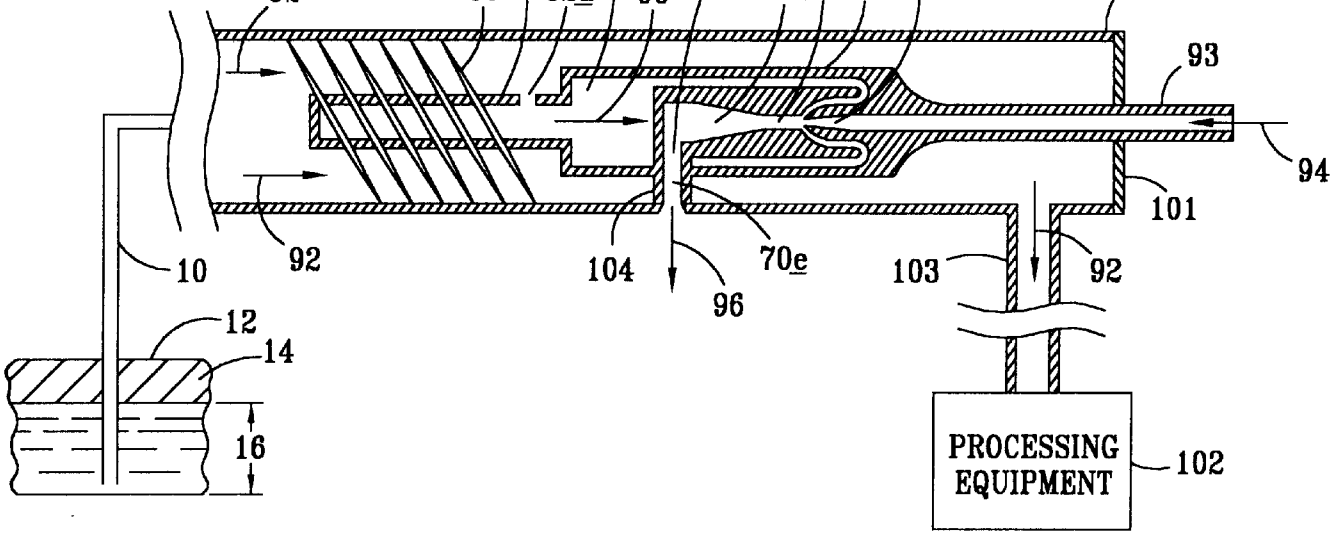
Figure 6:
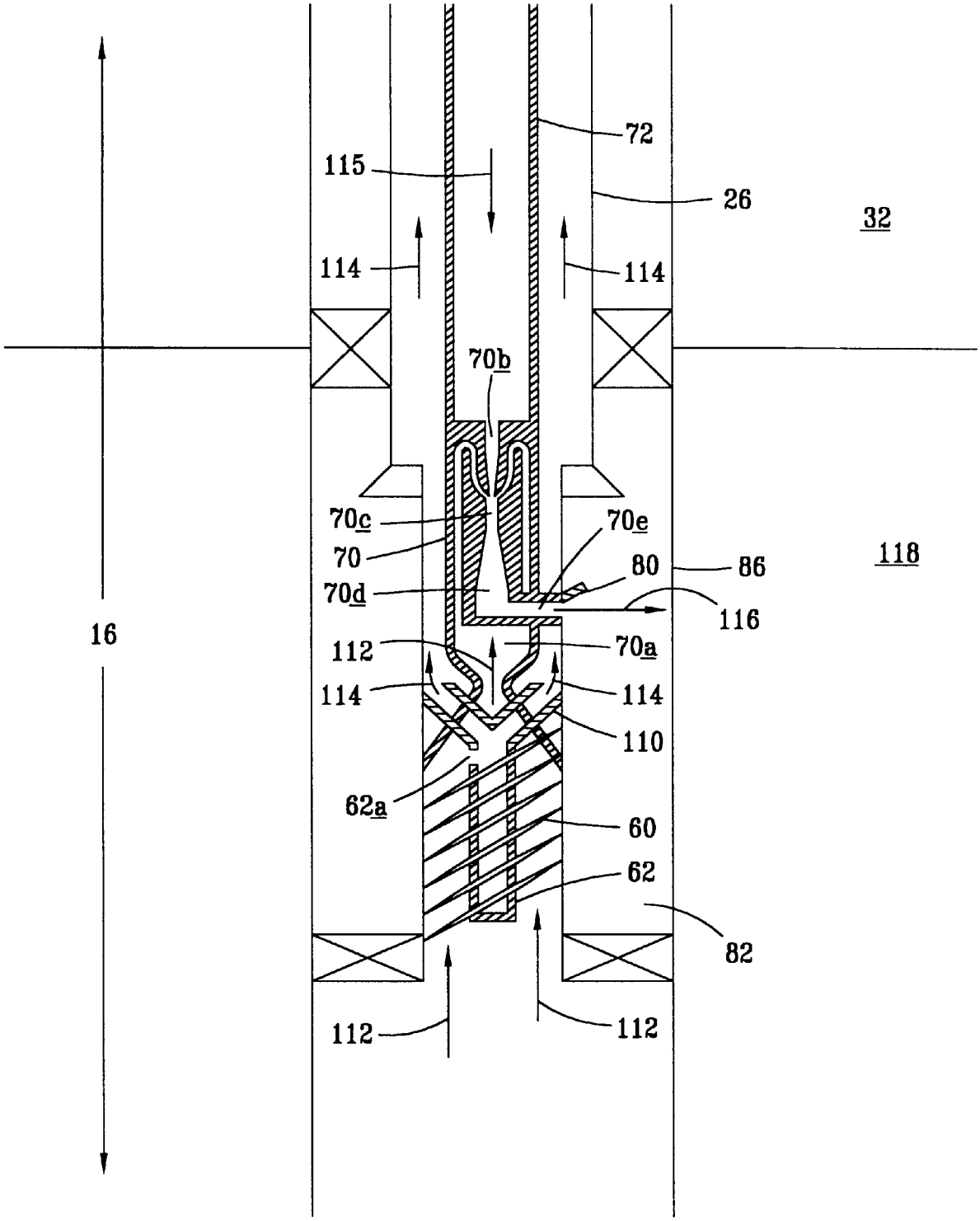
FIG. 6 is a schematic diagram of an alternate embodiment of the system of the present invention positioned in an existing wellbore.

The embodiments of FIGS. 4–6 are similar to the embodiments of FIGS. 2–3 and the same or similar components are given the same reference numerals. According to the embodiment of FIG. 4, the auger separator 60 and jet pump 70 are adapted for use in a surface pipeline or flowline 100 connected between the well bore 10 and surface processing equipment 102. To this end, high pressure gas is charged to the nozzle inlet 70*b* of the jet pump 70 via an inlet 93, as shown by the arrow 94, through the exterior wall of the flow line 100. The discharge outlet 70*e* is connected through a lateral tubing 104 extending through the exterior wall of the flowline 100 for discharging gas, as shown by the arrow 96, into a gas reinjection line, a gas transportation line, processing facilities, or the like (not shown). Otherwise, the operation of the embodiment of FIG. 4 is substantially identical to the operation of the embodiment of FIGS. 2–3.

The embodiment of FIG. 5 is substantially identical to that of FIG. 4 except that the flowline 100 is closed off with an end member 101 welded to the end thereof, and the inlet 93 extends straight through the end member 101. A discharge outlet line 103 extends from the exterior side wall of the flowline 100 for discharging an oil enriched mixture to the surface processing equipment 102. Operation of the embodiment of FIG. 5 is substantially identical to the operation of the embodiment of FIG. 4.

The embodiment of FIG. 6 is designed for removing water rather than gas from an incoming stream of fluids. While water may removed using the embodiment of FIG. 6, any fluid, such as an aqueous solution such as brine, which is heavier (i.e., having a greater specific gravity) than oil may be so removed, such fluids being referred to hereinafter as "water". Since water is heavier than oil, the auger separator 60 includes a cross-over configuration 110 which provides for water to enter the inlet chamber 70*a* of the jet pump 70, as shown by the arrow 112. Oil and gas then flow from the central discharge tube 62 around the jet pump 70, as shown by the arrow 114. The operation of the embodiment of FIG. 6 is similar to that of the previous embodiments except that water is injected as a power fluid through the coiled tubing 72, as shown by an arrow 115, into the nozzle inlet 70*b* and water is recovered from the jet pump and then passed, as shown by an arrow 116, through the check valve 80 into the annular space 82 and through the perforations 86 in the casing 22 into a downhole water zone 118.

It is understood that the present invention can take many forms and embodiments. Accordingly, several variations may be made in the foregoing without departing from the spirit or the scope of the invention. For example, two or more of the foregoing embodiments could be stacked in series to remove different portions of production fluid to thereby further enrich in oil the mixture of oil and gas recovered at the surface. The embodiment of FIG. 6 may, for example, be positioned beneath the embodiment of FIG. 2 so that water is removed and then gas is removed from the production fluids. In a further variation, the power fluid used in the embodiment of FIG. 6 may comprise gas instead of, or in combination with, water.

The investment to install the system of the present invention in a plurality of wells to reduce the gas produced from a field is substantially less than the cost of adding the additional separation and compression equipment at the surface. It also permits the reinjection of selected quantities of gas into the gas cap downhole from groups of wells, or individual wells from which oil production has become limited by reason of the capacity of the well tubing, surface pipelines, or flow lines to convey produced fluids away from the well thereby permitting increased production for such wells. Because the present invention permits gas to be reinjected downhole, an oil-enriched mixture of oil and gas may be produced to the surface. The present invention can also make certain formations which have previously been uneconomical to produce because of a high GOR, economical to produce because of the ability to reinject the gas or water downhole.

The present invention is, additionally, more reliable than systems which utilize rotating equipment such as compressors and turbines because the jet pump 70 can withstand production and power fluids of much poorer quality than those normally required for reasonable life in a subsurface pump or a subsurface compressor. Furthermore, much higher gas flow rates can typically also be obtained with the jet pump 70 than is possible with conventional subsurface pumps configured for the same tubing size.

It is also considered that the system of the present invention can be readily assembled and installed by techniques well known to those skilled in the art using off-the-shelf equipment available to the art.

The present invention has thus provided a method and a system for the recovery of additional oil from an oil bearing formation which produces a mixture of oil and gas at a greatly reduced cost and enhanced reliability by comparison to the previously used methods and equipment.

Having thus described the invention by reference to certain of its preferred embodiments it is noted that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, what is claimed is:

1. A method for producing from a first mixture of a first fluid and a second fluid a second mixture enriched in the second fluid, the second mixture being produced by removal of a portion of the first fluid from the first mixture, the method comprising:

a) separating at least a portion of the first fluid from the first mixture of the first and second fluids;

b) directing the separated first fluid into a jet pump;

c) injecting a power fluid into the jet pump at a pressure higher than the pressure of the first fluid to form a third mixture of the power fluid and the separated first fluid at a pressure intermediate the pressure of the power fluid and the separated first fluid;

d) discharging the third mixture of power fluid and separated first fluid; and, e) recovering the second mixture of the first and second fluids enriched in the second fluid.

2. The method of claim 1 wherein the step of injecting further comprises injecting the power fluid through a nozzle in the jet pump to generate a jet stream of the power fluid which draws the separated first fluid into the jet stream of power fluid to form the third mixture of power fluid and separated first fluid at a pressure intermediate the pressure of the power fluid and the separated first fluid.

3. The method of claim 1 wherein the first fluid comprises gas and the second fluid comprises liquid.

4. The method of claim 1 wherein the first fluid comprises water and the second fluid comprises a hydrocarbon.

5. The method of claim 1 further comprising the step of discharging the third mixture of power fluid and separated first fluid into a subterranean formation.

6. The method of claim 1 wherein the portion of the first fluid is separated from the second fluid in an oil well in a tubular member in fluid communication with an oil-bearing formation and with a tubing member extending to a surface.

7. The method of claim 6 wherein the step of separating is performed in an auger separator.

8. The method of claim 6 wherein the tubing member is a first tubing member having a second tubing member positioned therein and extending to the surface, and wherein the step of injecting further comprises compressing the power fluid at the surface and pumping the compressed power fluid through the second tubing member to the jet pump.

9. The method of claim 6 wherein the tubing member is a first tubing member having a second tubing member positioned therein and extending to the surface, and wherein the step of recovering further comprises directing the second mixture upwardly to the surface through an annular space between the first and second tubing members.

10. The method of claim 1 wherein the jet pump is located in a surface flowline.

11. A method for increasing oil production from an oil well producing a mixture of oil and gas through a well bore penetrating an oil-bearing formation containing a gas cap zone and an oil-bearing zone, the method comprising:

a) separating at least a portion of the gas from the mixture of oil and gas in the oil well to produce a separated gas and an oil-enriched mixture;

b) directing the separated gas into a jet pump;

c) injecting a power fluid at a pressure greater than the pressure of the separated gas into the jet pump to form a mixture of the power fluid and the separated gas, the mixture having a pressure greater than the pressure of the gas in the gas cap zone;

d) injecting the mixture of power fluid and separated gas into the gas cap zone; and e) recovering at least a substantial portion of the oil-enriched mixture.

12. The method of claim 11 wherein the step of injecting further comprises injecting the power fluid through a nozzle in the jet pump to generate a jet stream of the power fluid which draws the separated gas directed into the jet pump into the jet stream of power fluid to form the mixture of power fluid and separated gas at a pressure greater than the pressure of the gas in the gas cap zone.

13. The method of claim 11 wherein the step of injecting further comprises injecting the power fluid through a nozzle in the jet pump to generate a jet stream of the power fluid which enters into and passes through a throat portion of the jet pump and into a diffuser portion of the jet pump; and wherein the step of directing further comprises directing the separated gas into the jet stream of power fluid as the jet stream of power fluid enters the throat portion of the jet pump so that energy and momentum are transferred from the power fluid to the separated gas and so that the separated gas enters as a mixture with the power fluid into the diffuser portion of the jet pump at a pressure greater than the pressure in the gas cap zone.

14. The method of claim 11 wherein the step of separating is performed by an auger separator.

15. The method of claim 11 wherein the portion of the gas is separated from the mixture of oil and gas in the oil well in a tubular member in fluid communication with the oil-bearing formation and with a tubing member extending to a surface.

16. The method of claim 15 wherein the tubing member is a first tubing member having a second tubing member positioned therein and extending to the surface, and wherein the step of injecting further comprises compressing the power fluid at the surface and pumping the compressed power fluid through the second tubing member to the jet pump.

17. The method of claim 15 wherein the tubing member is a first tubing member having a second tubing member positioned therein and extending to the surface, and wherein the step of recovering further comprises directing the second fluid upwardly to the surface through an annular space between the first and second tubing members.

18. A system for increasing oil production from an oil well producing a mixture of oil and gas through a well bore penetrating an oil-bearing formation containing a gas cap zone and an oil-bearing zone, the method comprising:

a) an auger separator positioned in a first tubular member, the first tubular member being in fluid communication with the oil-bearing zone and oil and gas processing equipment at a surface;

b) a jet pump positioned in fluid communication with the auger separator to receive a separated gas from the auger separator at a jet pump inlet chamber;

c) a second tubular member positioned in fluid communication with a source of gas at a pressure higher than the pressure in the gas cap zone, and with a nozzle inlet of the jet pump; and d) a discharge passageway in fluid communication with a discharge outlet from the jet pump and with the gas cap zone.

19. The system of claim 18 wherein the outlet through the wall of the first tubular member comprises a check valve to prevent the flow of fluids into the jet pump through the passageway.

20. The system of claim 18 wherein the first tubular member is positioned in a lower end of a first tubing string extending to the surface.

* * * * *